United States Patent [19]

Weber et al.

[11] Patent Number: 4,466,359

[45] Date of Patent: Aug. 21, 1984

[54] DISC STABILIZED FLAME AFTERBURNER

[76] Inventors: Roy Weber, P.O. Box 336; Bruce C. Huddleston, 865 N. Kalaheo Ave., both of Kailua, Oahu, Hi. 96734

[21] Appl. No.: 243,400

[22] Filed: Mar. 13, 1981

Related U.S. Application Data

[60] Continuation-in-part of Ser. No. 65,800, Aug. 13, 1979, Pat. No. 4,345,529, which is a division of Ser. No. 906,814, May 17, 1978, Pat. No. 4,181,081, which is a continuation of Ser. No. 726,529, Sep. 27, 1976, abandoned.

[51] Int. Cl.[3] ..... F23B 5/00

[52] U.S. Cl. ..... 110/213; 110/214; 431/5; 422/182

[58] Field of Search ..... 110/210, 211, 212, 213, 110/214, 216; 431/5; 422/182

[56] References Cited

U.S. PATENT DOCUMENTS

| | | | |
|---|---|---|---|
| 1,064,477 | 6/1913 | Hatch . | |
| 2,646,758 | 7/1953 | Greemen . | |
| 2,711,139 | 6/1955 | Martin . | |
| 3,164,445 | 1/1965 | Hampel . | |
| 3,190,823 | 6/1965 | Bloxham . | |
| 3,215,101 | 11/1965 | Hoskinson . | |
| 3,215,501 | 11/1965 | Phillips . | |
| 3,248,178 | 4/1966 | Hoskinson et al. . | |
| 3,342,241 | 9/1967 | Whitesides | 431/5 |
| 3,408,167 | 10/1968 | Burden, Jr. et al. . | |
| 3,412,985 | 11/1968 | Perry et al. . | |
| 3,482,532 | 12/1969 | Moushegian et al. . | |
| 3,548,760 | 12/1970 | Yarnell et al. . | |
| 3,566,809 | 3/1971 | Carry et al. . | |
| 3,567,399 | 3/1971 | Altmann et al. . | |
| 3,606,877 | 9/1971 | Shipp . | |
| 3,610,180 | 10/1971 | Scott et al. . | |
| 3,611,955 | 10/1971 | Nimlim . | |
| 3,613,562 | 10/1971 | Brewer | 110/236 X |
| 3,631,823 | 1/1972 | Scogin . | |
| 3,646,897 | 3/1972 | Snelling . | |
| 3,706,289 | 12/1972 | Brewer . | |
| 3,730,112 | 5/1973 | Hutchinson et al. . | |
| 3,741,133 | 6/1973 | Kleinfelter . | |
| 3,832,144 | 8/1974 | Wieken et al. . | |
| 3,881,870 | 5/1975 | Hatfield . | |
| 4,023,508 | 5/1977 | Cantrell, Jr. et al. . | |
| 4,052,266 | 10/1977 | Griffith . | |
| 4,145,979 | 3/1979 | Lilley et al. | 110/210 |
| 4,181,081 | 1/1980 | Weber | 10/212 |

FOREIGN PATENT DOCUMENTS

| | | |
|---|---|---|
| 944480 | 12/1963 | United Kingdom . |
| 1036243 | 7/1966 | United Kingdom . |
| 1059345 | 2/1967 | United Kingdom . |
| 1072454 | 6/1967 | United Kingdom . |
| 1104378 | 2/1968 | United Kingdom . |
| 1214003 | 11/1970 | United Kingdom . |
| 1220010 | 1/1971 | United Kingdom . |
| 1518527 | 7/1978 | United Kingdom . |

*Primary Examiner*—Edward G. Favors

[57] ABSTRACT

Industrial pollution is directed into an afterburner conduit. An air cooled conical bluff body positioned in the conduit near the entrance acts as a flow condensing element. A recirculation zone consists of a toroidal vortex adjacent the downstream edge of the bluff body. In the zone, flow is reversed and particles in the reversed flow are reintroduced into the afterburner flow. A ring of burners located near the midpoint of the bluff body heats the gas stream flowing past the bluff body to near auto-ignition temperature. A second ring of burners located downstream of the bluff body assists in the establishment of a stabilized flame downstream of the bluff body. Air is heated as it flows through tubes wrapped around the conduit. The heated air is introduced tangentially to the afterburner flow by air injectors positioned downstream of the bluff body and downstream of the second ring of burners.

4 Claims, 8 Drawing Figures

1
2
3
4
5
6
7
8
9
10
18
23

1
2
3
4
5
6
7
8
9
10
11
12
13
14
15
16
17
18
19
20
24

19
20
12
BURNED GASES
REACTION ZONE
MIXING REGION
UNBURNED GASES
UNBURNED GASES

FIG. 3
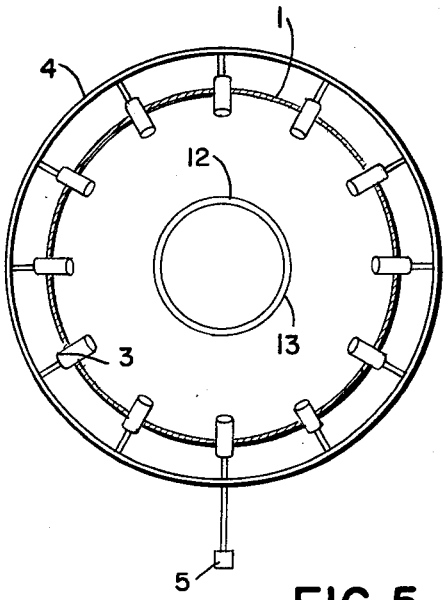
FIG. 4
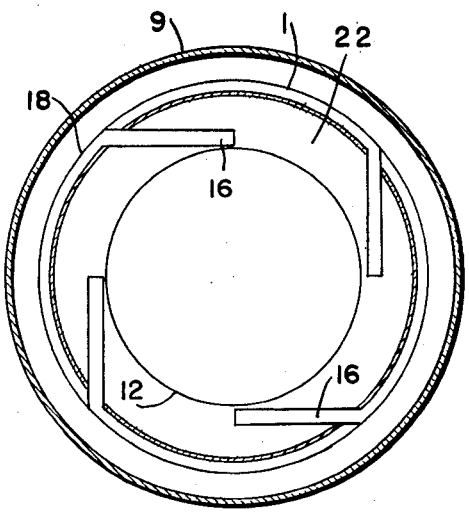
FIG. 5
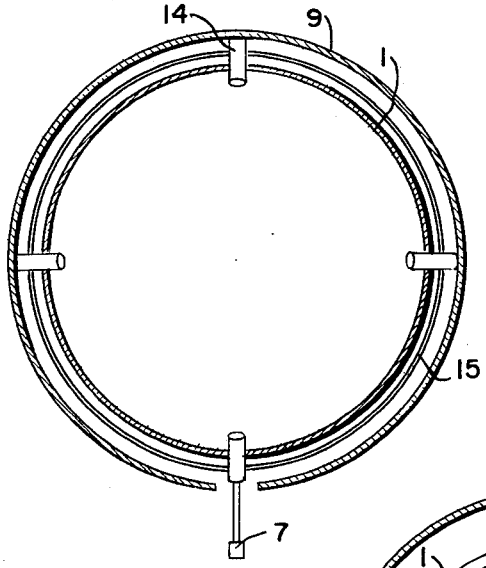
FIG. 6
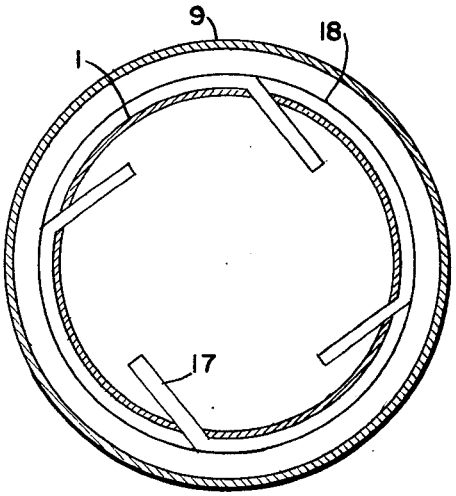
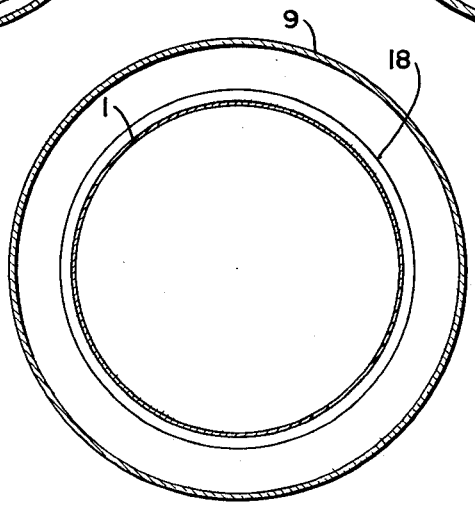
FIG. 7

DISC STABILIZED FLAME AFTERBURNER

This application is a continuation-in-part of application Ser. No. 65,800, filed Aug. 13, 1979, now U.S. Pat. No. 4,345,529, which is a division of application Ser. No. 906,814, filed May 17, 1978, now U.S. Pat. No. 4,181,081, which is a continuation of application Ser. No. 726,529, filed Sept. 27, 1976, now abandoned.

BACKGROUND OF THE INVENTION

This invention relates generally to pollution control apparatus and more particularly has reference to a disc stabilized flame afterburner which provides improved means to insure the complete oxidation of hydrocarbon released from any industrial process or equipment, such as paint baking ovens, solvent increasers, oil and solvent re-refining, food processing, varnish cookers, sulfuric acid manufacturing, sulfur scavaging plants, waste gas disposal systems, copper reclamation, steel reclamation, pathological waste disposal, wood treating equipment, pipe coating equipment, asphalt roofing, felt saturators or dryers. Characteristically, those processes and equipments release smoke and odors that violate anti-pollution laws.

Attempts to reduce the pollution generated by industrial processes and equipment have usually involved directing the pollutants into afterburners. Existing afterburners rely on providing an adequate temperature for a sufficient period of time for the hydrocarbons present to combine with free oxygen in the polluted gas stream to fully oxidize the gas stream. Those afterburners are limited in their performance as it is necessary to maintain relatively low gas velocities throughout the burner. Little provision is made for intimate mixing of the pollutants and the afterburner flame. The afterburner flame is characteristically distributed throughout the length of the afterburner as the relatively slow oxidation reaction takes place. Blow-by of microscopic carbon particles is a common problem. No provision is made to stabilize the afterburner flame. See, for example, U.S. Pat. Nos. 1,064,477; 2,646,758; 2,711,139; 3,741,133 and 4,181,081.

SUMMARY OF THE INVENTION

The present invention overcomes many of the problems which exist in the prior art.

The present invention provides a conical bluff body near the entrance to the afterburner conduit. As the gas stream moves past the bluff body, it is forced through a narrow annulus between the bluff body and the conduit. The annulus promotes intimate contact between the partially oxidized hydrocarbons in the afterburner flow and the oxygen from combustion air injectors. The bluff body acts as a flow condensing element which increases velocity of the flow in the afterburner and creates extreme turbulence in the flow.

A recirculation zone is formed immediately downstream of the bluff body. The zone serves as an ignition source for the gas stream that is passing through the afterburner in that it entrains hot products of combustion from the afterburner flame and reintroduces those products into the gas stream. The zone thus acts as a flame stabilizer.

Primary preheating burners located near the midpoint of the bluff body preheat the gas stream flowing past the bluff body to a temperature near the auto-ignition temperature of the hydrocarbons in the gas stream. That heating promotes rapid ignition of the gas stream as it passes by the bluff body and is struck by preheated air and hot products of combustion.

Secondary heating burners assist in the establishment of a stabilized flame downstream of the bluff body.

Hot combustion air is introduced tangentially to the flow stream through primary air injectors located immediately downstream of the bluff body and through secondary air injectors located immediately downstream of the secondary heating burners. The introduction of combustion air provides ideal combustion conditions downstream of the bluff body.

The products of incomplete combustion contained in pollutants become fully oxidized as the pollutants are directed through the afterburner. The afterburner exhaust is thus clear and pollution free.

An object of the invention is, therefore, to provide a simple and rugged device which overcomes the disadvantages associated with existing afterburners.

Another object of the invention is to provide an afterburner having a flame stabilized behind a bluff body located within the afterburner.

Still another object of the invention is to provide a toroidal vortex downstream of the bluff body in order to allow for the mixing of hot products of combustion with the flow of hydrocarbons passing by the edge of the bluff body.

Yet another object of the invention is to introduce combustion air into the afterburner tangentially to the direction of the gas stream flow, the combustion air being injected immediately downstream of the bluff body, the tangential direction of the combustion air flow causing a swirling flow which forces the afterburner flame against the afterburner lining to provide intimate mixing of the hot products of combustion, partially oxidized hydrocarbons, and free oxygen, as well as to provide a hot afterburner lining capable of igniting any remaining hydrocarbons.

A further object of the invention is to provide means to transfer the heat lost through the afterburner lining to the stabilized flame, said means comprising a preheat wrap of combustion air inlet tubing on the exterior of the afterburner lining downstream of the disc stabilized flame.

Still another object of the invention is to provide means to control the temperature of the bluff body by providing an air tubing wrap around the bluff body and by using the heated air as combustion air.

These and other and further objects and features of the invention are apparent in the disclosure which includes the above and below specification and claims and drawings.

BRIEF DESCRIPTION OF THE DRAWINGS

FIG. 3 is a sectional view of the afterburner taken along the line 3—3 of FIG. 2.

FIG. 4 is a sectional view of the afterburner taken along the line 4—4 of FIG. 2.

FIG. 5 is a sectional view of the afterburner taken along the line 5—5 of FIG. 2.

FIG. 6 is a sectional view of the afterburner taken along the line 6—6 of FIG. 2.

FIG. 7 is a sectional view of the afterburner taken along the line 7—7 of FIG. 2.

DETAILED DESCRIPTION OF THE INVENTION

Figure 1:
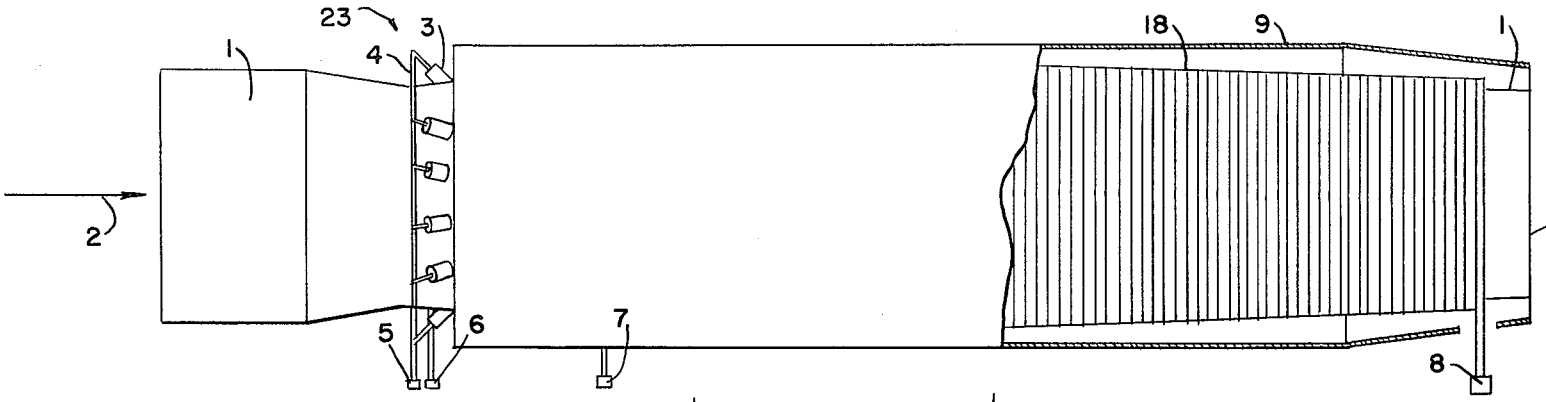
FIG. 1 is a side elevational view, partly in section, of an afterburner embodying the features of the present invention.
Figure 2:
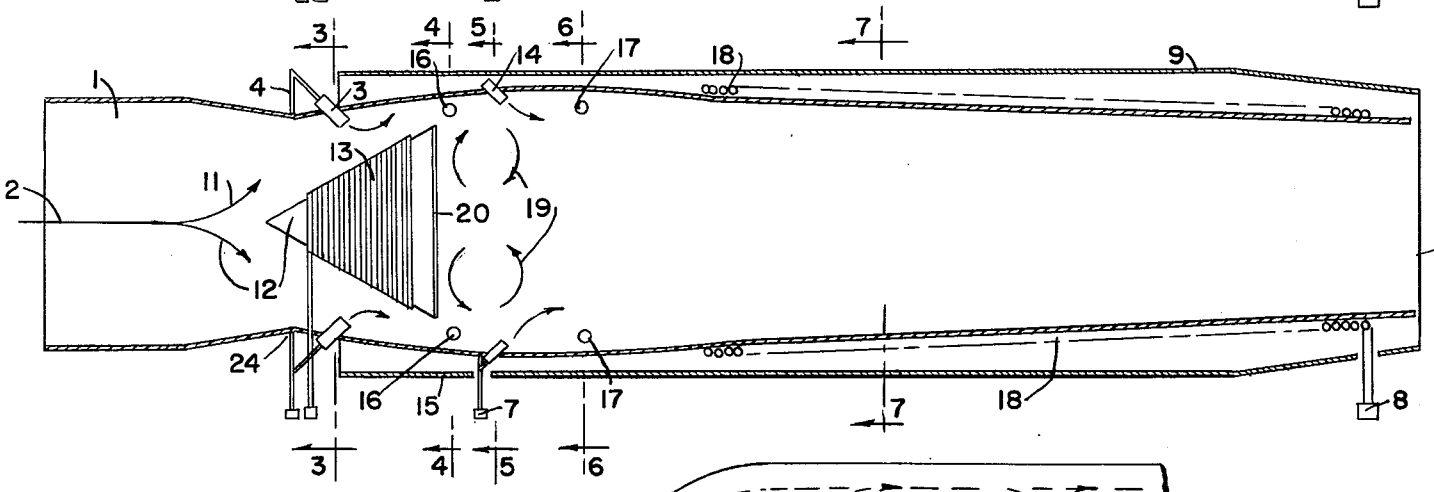
FIG. 2 is a sectional view taken along the longitudinal axis of the afterburner shown in FIG. 1.

It has been found that the products of incomplete combustion produced by industrial processes and equipment can be fully oxidized by being introduced into a reaction zone of an afterburner and being burned therein in a premixed flame if the aerodynamic conditions downstream of the diffusion flame are turbulent and if sufficient air is introduced to provide a mixture within the limits of flammability. Moreover, it has been found that the propagation velocity of the premixed flame can be increased dramatically if the flame is stabilized by preheating the fuel/air mixture or by radiation from the subsequent flame, either direct or reflected from the combustion area walls. A substantially greater increase in propagation velocity can be achieved by recirculation of combustion products.

The present invention takes advantage of those findings by providing an afterburner which has a high degree of turbulence in a stabilization region, a high degree of pre-heating of the fuel/air mixture, tangential entry of combustion air immediately adjacent to a bluff body to create a swirling flow in the afterburner, and a conical bluff body which creates a recirculation zone downstream of the bluff body.

As shown in the drawings, the afterburner 23 of the present invention includes a substantially airtight casing 1 which provides a conduit for gases and smoke produced by industrial processes and equipment. The casing 1 is formed of corrosion resistant and heat resistant material, such as stainless steel, titanium or refractory. The casing has a restriction 24 near the entrance, a gradually increasing diameter to the approximate midpoint, and a gradually decreasing diameter to the afterburner exit 10.

A removable heat shield 9 having high heat resistance and low thermal conductivity surrounds the casing 1 to minimize heat loss from the afterburner 23. Preferably, the heat shield 9 is formed of a steel and mineral fiber sandwich.

A conical bluff body 12 is positioned in the casing 1, the tip of the cone 12 being slightly upstream of the restriction 24 and the base 20 of the cone 12 being located downstream of the restriction 24. The bluff body 12 has a smaller diameter than the casing 1. Preferably, the bluff body 12 is a 45° cone. As the gas stream 11 moves past the bluff body 12 it is forced through a narrow annulus 22 between the bluff body 12 and the casing 1. The annulus promotes intimate contact between the partially oxidized hydrocarbons in the afterburner flow and the oxygen from the combustion air injection means discussed later.

The bluff body 12 is a flow condensing element which increases the velocity of the flow in the afterburner 23 and creates extreme turbulence in the flow.

Under certain conditions it may be useful to provide an induced draft fan upstream of the afterburner 23 to overcome flow resistance caused by the bluff body 12. Because the introduction of cool air upstream of the afterburner 23 would significantly increase fuel consumption of the afterburner 23, a high temperature fan that does not require air cooling of the flow entering the fan is used. The fan should be oil cooled to allow it to operate at temperatures as high as 1100° F. for extended periods of time.

The bluff body 12 is wrapped with small diameter copper tubing 13 which is connected to a compressed air source by a connector 6. Compressed air is forced through the copper tubing 13 to control the temperature of the bluff body 12 and thereby prevent the bluff body 12 from melting. Air passing through the tubing 13 becomes heated and that heated air is introduced tangentially into the gas stream passing by the bluff body 12 immediately adjacent to the base 20 of the bluff body 12.

Primary gas stream preheating means is located near the midpoint of the bluff body 12. The preheating means has a plurality of burners 3 arranged about the casing 1 and projecting therethrough. Preferably, the preheating means has twelve equally spaced burners 3 arranged in a ring pattern. The burners 3 are provided with any conventional combustible fuel through a main fuel supply line 4. The line 4 is joined to a fuel source by a connector 5. The burners 3 are angled toward the exit 10 of the afterburner 23. Preferably, the burners are angled at 45°.

The preheat burners 3 heat the gas stream 11 flowing past the bluff body 12 to a temperature near the auto-ignition temperature of the majority of the hydrocarbons present in the gas stream 11. Preferably, the burners 3 heat the gas stream to a temperature within a few hundred degrees of the auto-ignition point. That heating provides for the extremely rapid ignition of the gas stream as it passes the bluff body 12 and is struck by preheated air and hot products combustion.

Secondary heating means 14 is located downstream of the bluff body 12. The secondary heating means has a plurality of burners 14 arranged about the casing 1 and projecting therethrough. Preferably, the secondary heating means has four equally spaced burners 14 arranged in a ring pattern. The secondary burners 14 are angled toward the afterburner exit 10, preferably at 45°.

The function of the secondary burners 14 is to assist in the establishment of a stabilized flame downstream of the bluff body 12. After the flame has been stabilized, the secondary burners 14 are adjusted to a low setting. The amount of fuel entering the secondary burners 14 is controlled by an afterburner operator. The secondary burners are supplied with any conventional combustible fuel through a fuel supply line 15 which is supplied with fuel through a connector 7.

Preferably, the preheat burners 3 and secondary burners 4 are gas burners that use 100% outside air, the design being very similar to a Bunsen burner. The gas flow through the burners 3 and 4 is controlled remotely, so that they can be adjusted between full-on position and idle position. The burners 3 and 4 are ignited by high resistance wires located adjacent the burner gas flow. As current is forced through the wire by a remote starter, the temperature of the wire increases well above the ignition point of the gas flow, which ignites the burners 3 and 4.

Combustion air injection means includes a connector 8 connected to a high volume and high pressure compressed air source. Compressed air is forced through the connector 8 and through copper tubing 18 that is wrapped around the outside of the afterburner casing 1. The air becomes highly heated by heat lost through the afterburner casing 1. That lost heat is returned to the interior of the afterburner 23 when the heated air is reintroduced into the afterburner 23 as combustion air.

Preferably, air is introduced tangentially to the flow stream of the afterburner 23 through primary air injectors 16, which are located immediately downstream of the bluff body 12 and through secondary air injectors 17, which are located immediately downstream of the secondary burners 14.

As the combustion air enters the interior of the afterburner 23 through the air injectors 16 and 17 it provides ideal combustion conditions downstream of the bluff body 12. The partially oxidized hydrocarbons in the gas stream 11 react with the oxygen in the combustion air virtually instantaneously.

Air introduced by the air injectors provides sufficient oxygen to maintain a stabilized flame immediately downstream of the bluff body 12. The distance downstream is a function of the stack annulus ratio and flow velocity. A majority of the air required to change the fuel/air mixture in the afterburner 23 from fuel rich to stochiometric is introduced by the primary air injectors 16. The remainder of the stochiometric air requirement is introduced through the secondary air injectors 17. Air introduced by the secondary air injectors 17 assures the provision of sufficient oxygen to fully oxidize the hydrocarbons in the afterburner 23.

The introduction of the combustion air is in such a manner that the gas flow downstream of the air injection point is a swirling flow that concentrates the flame generated by the introduction of combustion air along the casing 1 to provide additional turbulence for the intimate mixing of partially oxidized hydrocarbons, free oxygen and hot products of combustion, as well as to force the hot products of combustion against the afterburner casing 1, thereby heating the casing to a high temperature, preferably above the auto-ignition point of the hydrocarbons, to serve as an ignition source for remaining hydrocarbons, to allow for a higher afterburner reaction rate, and to further stabilize the afterburner flame.

The amount of combustion air introduced into the afterburner 23 is controlled by an operator to provide sufficient air to oxidize the afterburner flow with a minimum of excess air.

A recirculation zone 19 is formed immediately downstream of the bluff body 12. The recirculation zone 19 acts as a flame stabilizer which prevents the flame from blowing out because of fluctuations in flow velocity. The recirculation zone 19 entrains hot products of combustion from the flame and reintroduces those products into the gas stream immediately adjacent the downstream 20 of the bluff body 12 for the purpose of rapidly igniting the gas stream.

More specifically, the recirculation zone 19 consists of a toroidal vortex in which the hot products of combustion of the afterburner flame enter a low pressure area downstream of the bluff body 12. The vortex remains stable regardless of the velocity of the flow entering the afterburner 23. As the hot products of combustion approach the downstream edge 20 of the bluff body 12 they are reintroduced into the gas stream flowing past the edge 20 of the bluff body 12. That occurs because the pressure of the gas stream is quite low in comparison to the pressure in the rest of the afterburner 23 due to the Bernoulli effect. The low pressure area that entrapped the hot products in the first place is the result of a partial vacuum immediately adjacent the downstream edge 20 of the bluff body 12. The vacuum is created by a pressure differential between the gas stream passing by the bluff body 12 and the gas stream downstream of the bluff body 12. The recirculation zone 19 serves as an ignition source for the gas stream 11 that is passing through the afterburner 23.

Figure 8:
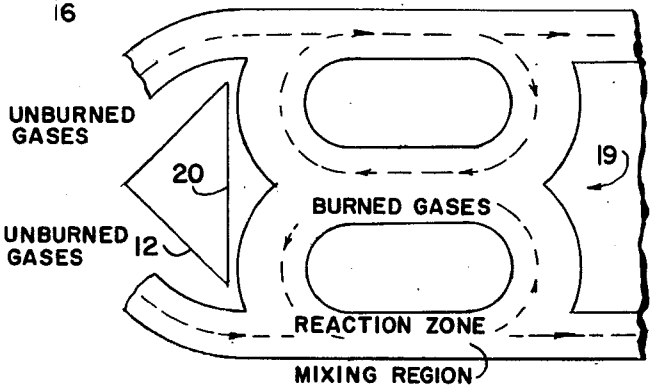
FIG. 8 is a schematic diagram of the flow path in the recirculation zone of the present invention.

Further understanding of the recirculation zone 19 is gained by reference to FIG. 8. A separation point develops as the afterburner flow is forced passed the bluff body 12. The separation point creates a toroidal vortex immediately downstream of the bluff body 12. In this region, the flow is reversed and the particles in the reversed flow are reintroduced into the afterburner flow. Those particles are at a very high temperature and serve to ignite the flow.

The flame stabilized behind the bluff body 12 is capable of handling very high flow rates through the afterburner 23 without emitting smoke or odor due to the ability of the afterburner geometry, heat sources, and oxygen sources to handle the hydrocarbons entering the afterburner 23 as a fuel source at the time they pass the downstream edge 20 of the bluff body 12.

An increase in the amount of hydrocarbons present in the gas stream entering the afterburner 23 serves to increase the maximum possible velocity of the gas flow entering the afterburner 23 provided that sufficient combustion air is available for injection into the afterburner 23 to exceed the stochiometric air requirement of the gas stream.

The casing 1 adjacent the bluff body 12 attains a very high temperature as the afterburner flame is forced against it. The casing 1 radiates heat into the combustion zone, which increases the maximum propagation velocity.

Radiation backwards from the high temperature combustion zone to the incoming fuel/air mixture is limited by the bluff body 12.

The recirculation zone is also capable of sustaining high flame propagation velocities downstream of the bluff body 12. By altering the speed of the induced draft fan it is possible to match the velocity of the fuel/air mixture entering the afterburner 23 to the propagation velocity of the flame.

The burners, compressed air supplies, fuel supplies, tubing, control valves, burner ignition means, and safety systems are conventional and are not described in detail.

While the invention has been described with reference to a specific embodiment, the exact nature and scope of the invention is defined in the following claims.

We claim:

1. Pollution control apparatus comprising a conduit having an inlet for receiving pollutants and an outlet for expelling relatively pollution free exhaust, flow diverting means positioned in the conduit in the vicinity of the inlet for condensing the flow of pollutants in the conduit, combustion means connected to the conduit for burning pollutants immediately downstream of the flow diverting means, and temperature control means connected to the flow diverting means for controlling the temperature of the flow diverting means.

2. The apparatus of claim 1 wherein the flow diverting means comprises a conical body and the temperature control means comprises tubing wrapped about the outer surface of the conical body and having an inlet connected to a source of pressurized air for forcing air through the tubing, heat being communicated from the body to air in the tubing.

3. Pollution control apparatus comprising a conduit having an inlet for receiving pollutants and an outlet for expelling relatively pollution free exhaust, a body positioned in the conduit in the vicinity of the inlet for condensing flow of pollutants in the conduit, said body having smaller radial dimensions than the conduit and being positioned in the conduit to direct the flow through an annular space between the body and the conduit, heating means connected to the conduit means for heating pollutants at the location of the body, said heating means comprising a plurality of burners arranged circumferentially about the longitudinal axis of the conduit, air injection means connected to the conduit for introducing sufficient oxygen into the conduit to maintain combustion of the heated pollutants immediately downstream of the body, said injection means comprising a plurality of air injectors arranged circumferentially about the longitudinal axis of the conduit to introduce oxygen into the conduit in a direction tangential to the flow path through the conduit, and second heating means for introducing heat into the conduit downstream of the air injection means, said second heating means comprising burners arranged circumferentially about the longitudinal axis of the conduit, the heating means having a greater number of burners than the second heating means.

4. Pollution control apparatus comprising a conduit having an inlet for receiving pollutants and an outlet for expelling relatively pollution free exhaust, the conduit being provided with a restriction in the vicinity of the inlet, tubing wrapped about an outer surface of the conduit downstream of a body means, said tubing having an inlet connected to a source of pressurized air for forcing air through the tubing, heat being communicated from the conduit to air in the tubing, and having an outlet connected to air injection means for supplying heated air to said air injection means, said body means positioned in the conduit in the vicinity of the inlet for forming a recirculation vortex combustion zone in the conduit immediately downstream of the body means, an annular space between said body means and said conduit providing communication between said combustion zone and said inlet, the body means comprising a conical body oriented with the apex toward the inlet and the base toward the outlet, the apex of the conical body being located slightly upstream of said restriction, said air injection means in the conduit downstream of the body means for introducing air into the combustion zone, heating means connected to the conduit upstream of the combustion zone for introducing heat into the conduit to heat pollutants, the heating means comprising a plurality of burners arranged circumferentially about the longitudinal axis of the conduit, said air injection means comprising a plurality of air injectors arranged circumferentially about the longitudinal axis of the conduit to introduce oxygen into the conduit in a direction tangential to the flow path through the conduit, the heating means being connected to the conduit at said annular space upstream of the combustion zone for introducing heat into said annular space to heat pollutants, thereat, said pollutants being directed past said body means into said combustion zone and being burned in said combustion zone, and second heating means for introducing heat into the conduit downstream of the air injection means and body means to promote said combustion zone, second air injector means for introducing sufficient oxygen into the conduit downstream of the second heating means to oxidize the pollutants in the conduit.

* * * * *